US010106905B2

(12) United States Patent
Murakami et al.

(10) Patent No.: US 10,106,905 B2
(45) Date of Patent: Oct. 23, 2018

(54) ANODIC OXIDE FILM AND METHOD FOR PERFORMING SEALING TREATMENT THEREON

(71) Applicant: Suzuki Motor Corporation, Shizuoka-ken (JP)

(72) Inventors: Haruhiko Murakami, Hamamatsu (JP); Masahiro Fujita, Hamamatsu (JP)

(73) Assignee: Suzuki Motor Corporation (JP)

( * ) Notice: Subject to any disclaimer, the term of this patent is extended or adjusted under 35 U.S.C. 154(b) by 240 days.

(21) Appl. No.: 14/442,593

(22) PCT Filed: Feb. 25, 2015

(86) PCT No.: PCT/JP2015/055400
§ 371 (c)(1),
(2) Date: Nov. 16, 2015

(87) PCT Pub. No.: WO2015/146440
PCT Pub. Date: Oct. 1, 2015

(65) Prior Publication Data

US 2016/0068986 A1 Mar. 10, 2016

(30) Foreign Application Priority Data

Mar. 27, 2014 (JP) ..... 2014-065954

(51) Int. Cl.
*C25D 11/24* (2006.01)
*C25D 11/02* (2006.01)
(Continued)

(52) U.S. Cl.
CPC ..... *C25D 11/246* (2013.01); *C25D 11/024* (2013.01); *C25D 11/12* (2013.01); *C25D 11/18* (2013.01); *C25D 11/24* (2013.01)

(58) Field of Classification Search
None
See application file for complete search history.

(56) References Cited

U.S. PATENT DOCUMENTS 5,411,607 A * 5/1995 Basaly ..... C25D 11/18 148/272
5,891,269 A 4/1999 Koerner et al.
(Continued)

FOREIGN PATENT DOCUMENTS

JP S60-134198 A 7/1985
JP H03277797 A 12/1991
(Continued)

OTHER PUBLICATIONS

JP2010077532 A Apr. 8, 2010_MT.*
(Continued)

*Primary Examiner* — Vera Katz
(74) *Attorney, Agent, or Firm* — Lerner, David, Littenberg, Krumholz & Mentlik, LLP

(57) ABSTRACT

Provided are an anodic oxide film of an anodic oxide film of an aluminum-based material and a method for performing a sealing treatment on the anodic oxide film which can achieve both high corrosion resistance and high repairing ability. A method may comprise applying direct current electrolysis to an aluminum-based material to form a second anodic oxide film. After which, an AC-DC superimposition electrolysis may be applied to the aluminum-based material to further form a first anodic oxide film. A sealing treatment may then be performed on the first and second anodic oxide films with a solution containing lithium ions.

4 Claims, 2 Drawing Sheets

(51) Int. Cl.
*C25D 11/12* (2006.01)
*C25D 11/18* (2006.01)

(56) References Cited

U.S. PATENT DOCUMENTS

| | | | | |
|---|---|---|---|---|
| 2006/0037866 | A1 | 2/2006 | Yamamoto et al. | |
| 2010/0219079 | A1* | 9/2010 | Routkevitch | B01D 53/228 205/175 |
| 2012/0217167 | A1* | 8/2012 | Tanaka | C25D 11/06 205/203 |
| 2015/0135969 | A1 | 5/2015 | Rubio et al. | |

FOREIGN PATENT DOCUMENTS

| | | | |
|---|---|---|---|
| JP | H11509579 | A | 8/1999 |
| JP | 2003003296 | A | 1/2003 |
| JP | 2005008948 | A | 1/2005 |
| JP | 2006083467 | A | 3/2006 |
| JP | 2009235539 | A | 10/2009 |
| JP | 2010077532 | A | 4/2010 |
| JP | 2014173128 | A | 9/2014 |
| WO | 2013171408 | A1 | 11/2013 |

OTHER PUBLICATIONS

Ono et. al. The Japan Institute of Light Metals, 2010 1463-1468.*
Supplementary European Search Report for Application No. EP15722916 dated Jan. 5, 2016.
International Search Report for Application No. PCT/JP2015/055400 dated May 26, 2015.

* cited by examiner

ANODIC OXIDE FILM AND METHOD FOR PERFORMING SEALING TREATMENT THEREON

CROSS-REFERENCE TO RELATED APPLICATIONS

The present application is a national phase entry under 35 U.S.C. § 371 of International Application No. PCT/JP2015/055400 filed Feb. 25, 2015, which claims priority from Japanese Patent Application No. JP 2014-065954 filed in the Japanese Patent Office on Mar. 27, 2014, the disclosures of which are hereby incorporated herein by reference.

TECHNICAL FIELD

The present invention relates to an anodic oxide film and a method for performing a sealing treatment on the anodic oxide film. In particular, the present invention relates to an anodic oxide film obtained by anodizing a material containing aluminum and a method for performing a sealing treatment on the anodic oxide film.

BACKGROUND ART

Conventionally, as a method for improving the corrosion resistance of aluminum or an aluminum alloy (hereinafter, aluminum or an aluminum alloy is also referred to as an aluminum-based material), an anodizing treatment has been conducted by which a porous anodic oxide film is formed on a surface of the aluminum-based material. In general, pores are arranged regularly in the porous layer of the anodic oxide film, although this greatly depends on the electrolysis conditions. This is a factor that causes decrease in corrosion resistance of the anodic oxide film.

In such a treatment, a sealing treatment for sealing the pores is conducted after the anodizing treatment for the improvement of corrosion resistance. An energy-saving sealing treatment has been proposed which is conducted at a lower temperature in a shorter time than a conventional high-temperature hydration type sealing treatment and which can provide corrosion resistance not inferior to the corrosion resistance provided by the high-temperature hydration type sealing treatment (Patent Document 1).

PRIOR ART DOCUMENT

Patent Document

[Patent Document 1] Japanese Patent Application Publication No. 2010-77532

SUMMARY OF INVENTION

No method has been found so far for further enhancing the corrosion resistance by a sealing treatment using a sealing treatment liquid containing lithium ions (hereinafter, also referred to as a lithium ion sealing liquid). In addition, no method has been found so far in which the repairing ability achieved by repairing a crack or a flaw formed on a surface of an anodic oxide film is further enhanced by, for example, a sealing treatment with a lithium ion sealing liquid, and both high corrosion resistance and high repairing ability are achieved. Accordingly, there is a demand for a method that provides both corrosion resistance and repairing ability, and also makes it possible to obtain higher corrosion resistance and higher repairing ability.

In view of the above-described problems, an object of the present invention is to provide an anodic oxide film of an aluminum-based material and a method for performing a sealing treatment on the anodic oxide film which can achieve both high corrosion resistance and high repairing ability.

A mode of a method for performing a sealing treatment on an anodic oxide film according to the present invention comprises the steps of:

- applying direct current electrolysis to an aluminum-based material to form a second anodic oxide film;
- applying, after the step, AC-DC superimposition electrolysis to the aluminum-based material to further form a first anodic oxide film; and
- performing a sealing treatment on the first and second anodic oxide films with a solution containing lithium ions.

The present invention makes it possible to provide an anodic oxide film and a sealing treatment on an anodic oxide film which achieve both high corrosion resistance based on a synergistic effect of the anodic oxide film obtained by the AC-DC superimposition and the sealing treatment and the repairing ability based on the anodic oxide film obtained by using a direct current and the sealing treatment with the lithium ion sealing liquid.

Figure 3A:
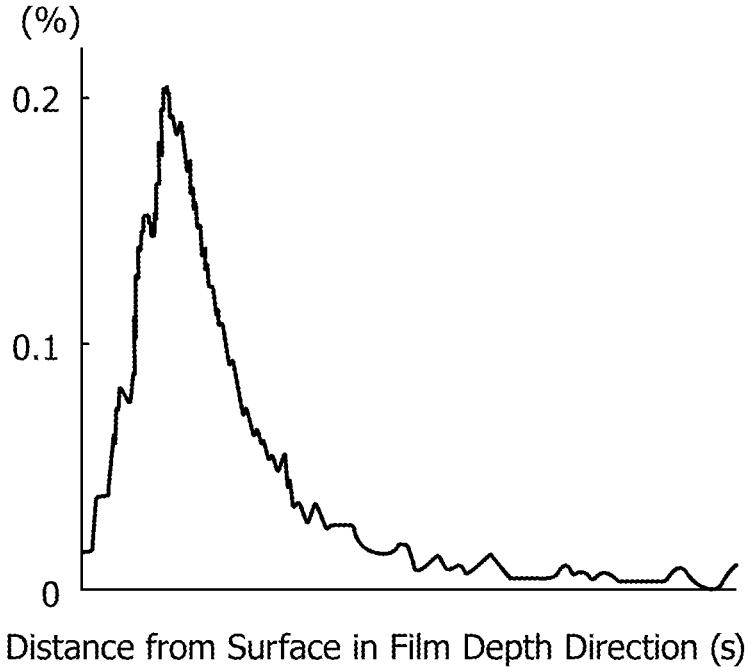
Figure 3B:
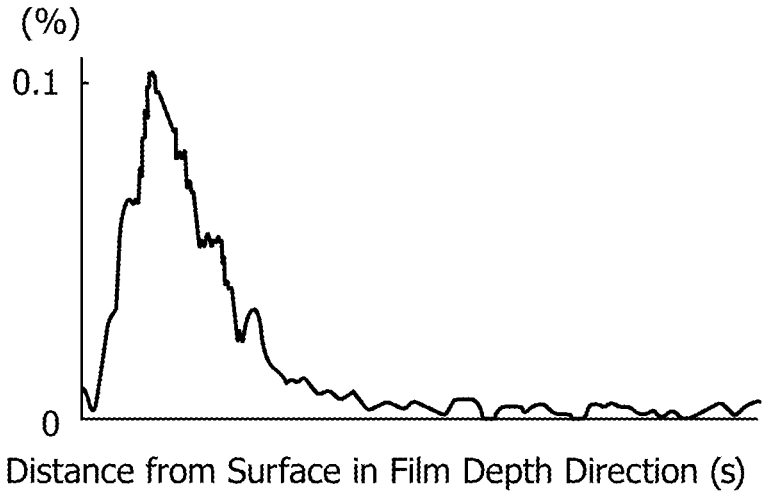

Parts (a) and (b) of FIG. 3 are graphs which relate to the anodic oxide film and the method for performing a sealing treatment on the anodic oxide film according to the present invention, and which show the lithium concentrations in Examples after a salt spray test.

DESCRIPTION OF EMBODIMENT

An embodiment of a method for performing a sealing treatment on an anodic oxide film according to the present invention will be described in further detail with reference to the attached drawings.

Substances to which the method for performing a sealing treatment on an anodic oxide film according to this embodiment is directed are aluminum-based materials. The "aluminum-based materials" in this embodiment means aluminum, as well as aluminum alloys containing an alloy component such as silicon or copper; and aluminum alloys such as wrought aluminum materials, cast aluminum materials, and die-cast aluminum materials (ADC) containing any of these.

In an anodic oxide film formation step, an aluminum-based material serving as an anode and titanium (Ti) serving as a cathode are disposed in an anodizing treatment liquid. By electrolysis of the anodizing treatment liquid, an anodic oxide film mainly containing aluminum oxide is formed near the surface of the aluminum-based material. The anodic oxide film provides functions such as corrosion resistance and wear resistance to the aluminum-based material. Note that the cathode material only needs to be a material that functions as a cathode, and it is possible to use a stainless steel plate or the like, instead of titanium.

Figure 1:
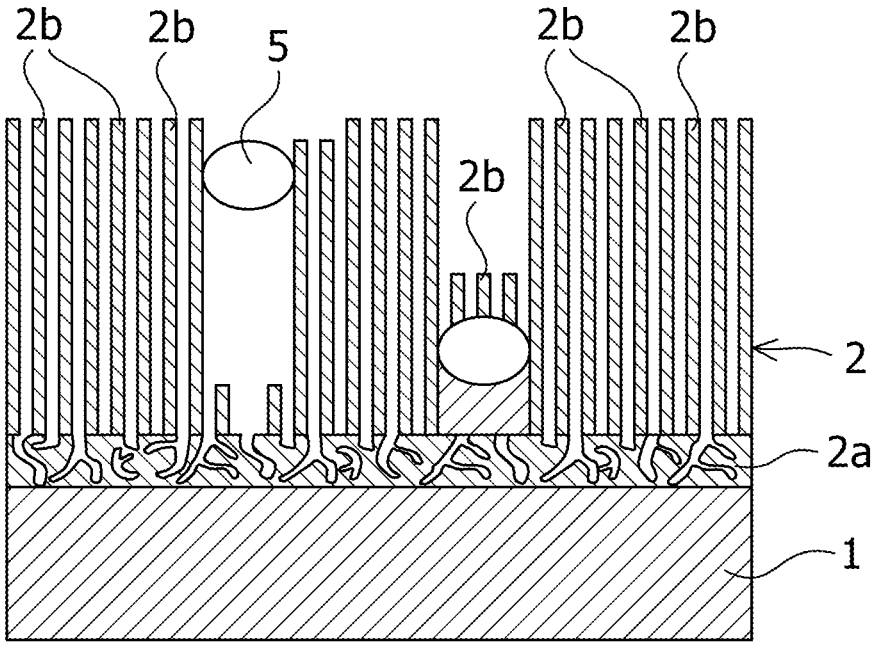
FIG. 1 is a schematic view which relates to an anodic oxide film and a method for performing a sealing treatment on the anodic oxide film according to the present invention, and which shows a cross-section of an aluminum-based material on which an anodic oxide film formation step has been conducted.

FIG. 1 is a schematic view of a cross-section of an aluminum-based material 1 on which the anodic oxide film formation step has been conducted. As shown in FIG. 1, an anodic oxide film 2 is formed on a surface of the aluminum-based material 1. The anodic oxide film 2 includes a first anodic oxide film (hereinafter, also referred to as an AC-DC superimposition electrolysis anodic oxidation layer) 2*a* and a second anodic oxide film (hereinafter, also referred to as a direct-current electrolysis anodic oxidation layer) 2*b*. The anodic oxide film 2 has multiple types of pores which differ in any or all of size, number, and distribution. In the anodic oxide film formation step, a first anodic oxide film formation step of forming the second anodic oxide film 2*b* and a second anodic oxide film formation step of forming the first anodic oxide film 2*a* are conducted separately. When components in anodizing treatment liquids for the direct-current electrolysis anodic oxidation layer and the AC-DC superimposition electrolysis anodic oxidation layer are the same, these layers can be formed continuously only by changing the electrolysis conditions. Note that when the aluminum-based material 1 is an aluminum alloy containing silicon, silicon 5 is included inside the anodic oxide film.

In the first anodic oxide film formation step, the second anodic oxide film 2*b* is formed by applying direct current electrolysis to the aluminum-based material 1. In this step, the second anodic oxide film 2*b* is formed on a surface mainly including an upper portion of the surface of the anodic oxide film 2. The second anodic oxide film 2*b* is oriented. For this reason, the second anodic oxide film 2*b* has a larger amount of pores (second pores) than the first anodic oxide film 2*a* described later. In addition, the presence of the silicon 5 and the like also contributes to the formation of the second pores. A sealing treatment and a repair treatment described later can cause a large amount of lithium ions and a lithium compound originated from the lithium ions to be present in the second pores. The second anodic oxide film 2*b* has corrosion resistance, and can prevent substances which otherwise would cause corrosion from reaching the aluminum-based material 1. Consequently, the second anodic oxide film 2*b* can provide corrosion resistance to the aluminum-based material 1. In addition, the second anodic oxide film 2*b* can provide a high degree of ability to repair cracks, and can maintain a repairing effect for a long period.

In the second anodic oxide film formation step, the first anodic oxide film 2*a* is formed by applying AC-DC superimposition electrolysis to the aluminum-based material 1 on which the second anodic oxide film 2*b* is formed. Specifically, the second anodic oxide film formation step is conducted by the AC-DC superimposition method in which a direct current is superimposed on an alternating current. In this step, the first anodic oxide film 2*a* is formed near an interface mainly including a portion on the surface of the aluminum-based material 1. In other words, the first anodic oxide film 2*a* is formed between the aluminum-based material 1 and the second anodic oxide film 2*b* near the interface with the aluminum-based material 1. The first anodic oxide film 2*a* is also a porous film formed by applying AC-DC superimposition electrolysis, and has multiple pores (first pores). In addition, the presence of the silicon 5 and the like slightly contributes to the formation of the first pores. The first anodic oxide film 2*a* is dense because of the random orientation (i.e., the first anodic oxide film 2*a* is not oriented or is slightly oriented), and is less in the size, number, distribution of the pores and the like than the second anodic oxide film 2*b*. The first anodic oxide film 2*a* is dense and the second anodic oxide film 2*b* is sparse in terms of any or all of size, number, and distribution of the pores. Accordingly, the first anodic oxide film 2*a* has a higher gas-tightness than the second anodic oxide film 2*b*, and can prevent substances which otherwise would cause corrosion from reaching the aluminum-based material 1. In addition, the first anodic oxide film 2*a* can provide higher corrosion resistance to the aluminum-based material 1 because of the high denseness and the sealing treatment described later. Note that the term "dense" means that the anodic oxide film is smaller and less in the size and number (distribution) of the pores than the other anodic oxide film.

As the anodizing treatment liquid, it is possible to use either an acidic bath of sulfuric acid ($H_2SO_4$), oxalic acid ($H_2C_2O_4$), phosphoric acid ($H_3PO_4$), chromic acid ($H_2CrO_4$), or the like or a basic bath of sodium hydroxide (NaOH), sodium phosphate ($Na_3PO_4$), sodium fluoride (NaF), or the like. The aluminum-based material 1 in which the anodic oxide film 2 to be subjected to the sealing treatment described later is formed on the surface is not limited to a case in which a specific anodization bath is used, but a sulfuric acid bath is preferable from a practical viewpoint.

The film thickness of the anodic oxide film is preferably, but is not particularly limited to, 3 μm or more and 60 μm or less from the viewpoint of practicability. The film thickness of the anodic oxide film can be set to a film thickness necessary for the application by adjusting the current application time in the anodic oxide film formation step.

As a washing treatment step, it is preferable to conduct a pretreatment such as washing with water on the aluminum-based material after the first anodic oxide film formation step and before the sealing treatment described later. The washing treatment can prevent contamination of a lithium ion sealing liquid with the anodizing treatment liquid attached to the aluminum-based material. This makes it possible to always conduct an adequate sealing treatment. In addition, since the anodizing treatment liquid in the pores of the anodic oxide film 2 can be removed, a larger amount of lithium ions can be provided on the inside of the anodic oxide film. This contributes to the improvements in a sealing effect by the sealing treatment described later and the repairing effect by the repair treatment.

As a sealing treatment step, a lithium ion sealing liquid (strongly basic sealing bath) containing at least lithium ions is attached onto the surface and the inside of the anodic oxide film. The lithium ion sealing liquid containing lithium ions is allowed to penetrate into the pores of the anodic oxide film. The lithium ion sealing liquid containing lithium ions enters the pores of the anodic oxide film, and forms a compound in the pores. In this manner, the pores are sealed, and an aluminum compound which reacts with water in a repair treatment, described later, can be caused to be present in the anodic oxide film. Lithium (Li), which is contained in the lithium ion sealing liquid, is an extremely small element, and hence readily enters crevices of the film and reacts in the crevices. Accordingly, lithium can stably provide corrosion resistance and repairing ability to the first anodic oxide film and the second anodic oxide film. Moreover, lithium is less sensitive to the number of times of the treatment and incurs lower costs for managing the liquid agent than the elements in the same group such as sodium (Na) and potassium (K). For this reason, the production costs can be reduced.

Figure 2:
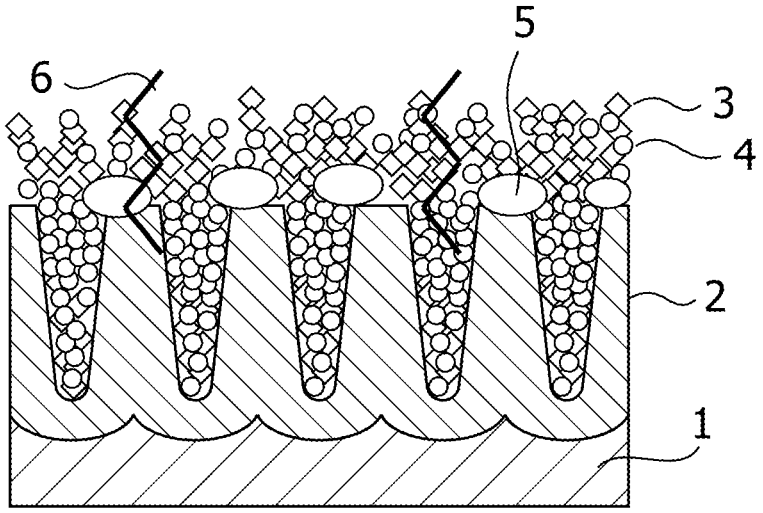
FIG. 2 is a schematic view which relates to the anodic oxide film and the method for performing a sealing treatment on the anodic oxide film according to the present invention, and which shows a cross-section of the aluminum-based material on which a sealing treatment step has been conducted.

FIG. 2 is a schematic view showing a cross-section of the aluminum-based material 1 on which the sealing treatment step has been conducted. As shown in FIG. 2, the anodic oxide film 2 is formed on a surface of the aluminum-based material 1. Hydrated alumina 3 (AlO.OH) and a lithium compound 4 (for example, $LiH(AlO_2)_2.5H_2O$) are formed in the pores of the anodic oxide film 2 by the sealing treatment. When the aluminum-based material 1 is an aluminum alloy containing silicon, the silicon 5 included inside the anodic oxide film 2 is deposited because of the dissolution of the anodic oxide film 2 in the sealing treatment. In addition, the lithium compound 4 is present from the surface of the anodic oxide film 2 to the vicinity of the interface with the aluminum-based material 1.

The sealing treatment step is preferably conducted by applying or spraying a treatment liquid onto a workpiece having the anodic oxide film or immersing the workpiece in the treatment liquid, and then holding the workpiece in the air, followed by washing with water and drying. In addition, it is also preferable to conduct immersion in the workpiece having the anodic oxide film in the treatment liquid and take the workpiece out of the treatment liquid 0.5 minutes or more later, followed by washing with water and drying. The sealing treatment method based on the application or spraying enables a partial sealing treatment. For this reason, in a treatment on a large part, this eliminates the need for a large tank for immersing the large part in the treatment. The drying temperature in the drying treatment is preferably in the range from 100° C. up to 150° C. from the viewpoint of practicability.

As an agent serving as lithium ions or a lithium ion source contained in the lithium ion sealing liquid, it is possible to use lithium hydroxide (LiOH), lithium sulfate ($Li_2SO_4$), lithium chloride (LiCl), lithium silicate ($Li_2O_3Si$), lithium nitrate ($LiNO_3$), lithium carbonate ($Li_2CO_3$), lithium phosphate ($Li_3PO_4$), or a hydrate thereof. Of these agents, lithium hydroxide, lithium carbonate, or lithium silicate is preferable, because an aqueous solution thereof is basic. In addition, lithium silicate is not practical, because of toxicity and poor water-solubility. Accordingly, the lithium ion sealing liquid is more preferably that of lithium hydroxide or lithium carbonate, from the viewpoint of practicability.

The lithium ion concentration of the lithium ion sealing liquid only needs to be from 0.02 g/L up to 20 g/L. When the concentration of lithium ions is 0.02 g/L or more, the reaction in the sealing treatment is promoted. The lower limit of the concentration is preferably 0.08 g/L or more, and more preferably 2 g/L or more. The upper limit of the concentration is more preferably 10 g/L or less. The reaction proceeds rapidly in a lithium ion sealing liquid having a lithium ion concentration exceeding 10 g/L. This may cause dissolution of an aluminum substrate having no anodic oxide film.

The value of pH of the lithium ion sealing liquid is preferably from 10.5 up to 14.0 and more preferably from 12.0 up to 14.0, but this is not particularly limited thereto. The lithium ion sealing liquid is basic within the above-described range, and hence readily reacts with the film treated with the acidic aqueous solution, so that the lithium compound described later can be formed rapidly. In particular, when the value of pH is 12.0 or more, the lithium compound can be formed more rapidly. If the value of pH is less than 10.5, the corrosion ratio is so high that the effect to improve the corrosion resistance may be lowered. If the value of pH exceeds 14.0, excessive dissolution of the anodic oxide film may occur. Note that the value of pH varies depending on the lithium ion source. In this case, the value of pH of the lithium ion sealing liquid can be adjusted by using an acid such as sulfuric acid ($H_2SO_4$), oxalic acid ($H_2C_2O_4$), phosphoric acid ($H_3PO_4$), or chromic acid ($H_2CrO_4$) or a base such as sodium hydroxide (NaOH), sodium phosphate ($Na_3PO_4$), or sodium fluoride (NaF).

The temperature of the lithium ion sealing liquid only needs to be 65° C. or less, and is preferably from 10° C. up to 65° C. and is more preferably from 25° C. up to 50° C. When the treatment is conducted at a temperature below 25° C., the activity is low, and the reaction is sluggish, but corrosion resistance can be expected to some degree. When the treatment is conducted at a temperature exceeding 50° C., especially 65° C., there is a possibility that high corrosion resistance cannot be obtained, because the dissolution of the film proceeds which starts from the surface of the anodic oxide film, and the film disappears.

The treatment time (immersion time) with the lithium ion sealing liquid needs to be 0.5 minutes or longer. When the treatment time is 0.5 minutes or longer, high corrosion resistance can be obtained. In addition, the treatment time is preferably 5 minutes or less. If the treatment time exceeds 5 minutes, there is a possibility that the dissolution of the film will proceed preferentially, and the corrosion resistance will decrease. Note that, regarding the treatment time, it is also possible to provide a holding time for which the workpiece is held in the air after the immersion and to employ the immersion time and the holding time together as the treatment time. In this case, the elution of aluminum ions into the treatment liquid can be reduced.

By conducting the sealing treatment step, the anodic oxide film 2 undergoes a chemical reaction, and hence the strength decreases at the portions of the anodic oxide film between pores. In the sealing treatment with the aqueous solution containing lithium ions, the lithium compound 4 is formed densely, especially in the surface of the anodic oxide film 2. Consequently, a pressure is generated from the inside of the pores to the anodic oxide film side 2 at the surface portion of the anodic oxide film 2. The pressure causes formation of cracks in the anodic oxide film 2, so that pores become continuous with each other. The hydrated alumina 3 and the lithium compound 4 inside the pores have low strength, because they are in the form of aggregates of extremely small pieces of these compounds. For this reason, the impact at the time at which the pores become continuous with each other or the like generates cracks also in the aggregates of the hydrated alumina 3 or the lithium compound 4 in the pores. A large numbers of such cracks in the sizes at the nanolevel become continuous with each other, and grow to large cracks. Consequently, many cracks are formed in a portion at a depth of approximately 1 μm where the lithium compound 4 is formed especially densely. In addition, some cracks may reach not only the anodic oxide film 2 but also the underlying aluminum-based material 1. Such flaws are created when a part obtained by processing the aluminum-based material 1 bumps another part, or the anodic oxide film 2 is made to have a flaw by a cutter, a file, or the like. In this embodiment, the cracks and flaws are collectively referred to as "cracks."

In the repairing step, cracks formed in one or both of the first anodic oxide film and the second anodic oxide film can be repaired after the sealing treatment step is conducted. In addition, in the repairing step, cracks reaching the aluminum-based material present below the anodic oxide film can also be repaired. The cracks in the aluminum-based material are repaired by using a repair treatment liquid containing at least one of a halogen compound and an alkali metal compound.

The repairing step can be conducted by immersing an aluminum-based member in the repair treatment liquid. It is also possible to cover the cracks with a water-absorbing processed product or naturally occurring material such as a cloth, paper, or sponge, impregnated with the repair treatment liquid. Moreover, the cracks can also be repaired by bringing the repair treatment liquid into contact with the cracks by spraying the repair treatment liquid into the cracks by using a spray or other methods. The sealing treatment method using the processed product, the material, or the spraying enables a partial repair treatment. In a treatment on a large part, this can eliminate the need for a large tank for immersing the large part.

Halogen compounds used for the repair treatment liquid include sodium chloride (NaCl), potassium chloride (KCl), lithium chloride (LiCl), and the like. Meanwhile, alkali metal compounds used for the repair treatment liquid include sodium hydrogen carbonate ($NaHCO_3$), sodium dihydrogen phosphate ($H_2NaO_4P$), sodium hydrogen phosphate ($Na_2HPO_4$), trisodium phosphate ($Na_3PO_4$), sodium sulfate ($Na_2SO_4$), lithium sulfate ($Li_2SO_4$), and the like. Note that these halogen compounds and alkali metal compounds are mere examples, and the halogen compounds and alkali metal compounds are not limited to these compounds. One of the halogen compound and the alkali metal compound may be contained alone in the repair treatment liquid, or the halogen compound and the alkali metal compound may be contained so as to coexist. Moreover, the repair treatment liquid can contain a pH adjusting agent and the like, in addition to the halogen compound and the alkali metal compound described above.

The halogen compound or the alkali metal compound contained in the repair treatment liquid causes dissolution of the anodic oxide film. The aluminum compound constituting the anodic oxide film reacts with water to form a hydrated compound made of aluminum and oxygen. The hydrated compound is deposited inside the cracks, so that the cracks can be repaired. Moreover, when the anodic oxide film is dissolved in the repair treatment liquid, the lithium compound which is a sealing product moves to the inside of the cracks, and is filled into the cracks, so that the cracks can be repaired.

In addition, when the cracks reach the aluminum-based material, a passivation film made of aluminum oxide, aluminum hydroxide, and the like is formed in the cracks of the aluminum-based material by using the repair treatment liquid. The film thickness of the passivation film is less than 1 μm and is made of the same elements as those of the anodic oxide film. The passivation film is formed in the cracks rapidly, and a layer made of any one or both of the hydrated compound of aluminum and oxygen and the lithium compound, which is the sealing product, is formed on the passivation film. Thus, a layer structure of at least two layers is formed. The structure can achieve an effect of preventing the corrosion of the aluminum-based material and an effect of covering the cracks in the repairing step to make the cracks less noticeable.

The concentration of one or both of the halogen compound and the alkali metal compound in the repair treatment liquid is preferably from 0.01 mol/L up to 3.5 mol/L. Within the above-described concentration range, the cracks can be repaired by controlling the temperature of the repair treatment liquid. More specifically, when the concentration of the repair treatment liquid is from 0.01 mol/L up to 0.14 mol/L, the temperature is preferably set from 60° C. up to 95° C. When the concentration of the repair treatment liquid is from 0.15 mol/L up to 1.0 mol/L, the temperature is preferably set from 5.0° C. up to 95° C. When the concentration of the repair treatment liquid is from 1.1 mol/L up to 2.5 mol/L, the temperature is preferably set to be from 5.0° C. up to 60° C. Meanwhile, when the concentration of the repair treatment liquid is from 2.6 mol/L up to 3.5 mol/L, the temperature is preferably set to be from 5.0° C. up to 25° C.

The value of pH of the repair treatment liquid is preferably from 5.0 up to 10. The value of pH of the repair treatment liquid within the above-described range makes it possible to dissolve the aluminum compound constituting the anodic oxide film 2, deposit the hydrated compound in the cracks, and allow the movement of the lithium compound in a balanced manner. For this reason, the cracks can be repaired efficiently. If the value of pH of the repair treatment liquid is lower than 5.0 or higher than 10, the anodic oxide film 2 and the aluminum-based material 1 may be dissolved. Hence, there is a possibility that the cracks will become larger, or the anodic oxide film 2 will be dissolved to expose the underlying aluminum-based material 1.

The treatment time in the repairing step varies depending on the sizes of the cracks, and hence is not particularly limited. Regarding the treatment time, for example, when a crack having a width of about several micrometers is repaired by immersion, the crack can be repaired by immersion in the repair treatment liquid for 30 minutes to 1 hour. A visible crack having a width of about 1 mm can be repaired in about one day to five days. Note that further immersion of the aluminum-based member in the repair treatment liquid after the crack is repaired does not cause any problem, because reactions which lead to excessive dissolution of the anodic oxide film and the like do not occur, and the crack remains covered.

It is possible to conduct, before the repairing step, a removal step of removing soil, oil, dust, and the like from either or both of the anodic oxide film and the aluminum-based material. It is also possible to conduct, after the repairing step, a washing step of washing either or both of the anodic oxide film and the aluminum-based material with pure water or the like. Moreover, it is possible to conduct, after the repairing step or after the sealing treatment step, a coating step using the anodic oxide film as an undercoat. The coating step is conducted in a continuous line by replacing a jig. In this case, the workpiece may be soiled by the replacement of the jig. Hence, it is necessary to conduct degreasing as a pretreatment in the coating. In this embodiment, the lithium ion sealing liquid, which is a strong base, is used in the above-described sealing treatment. For this reason, the amount of the residual components which have to be degreased is small, and the decrease in coating adhesion in the coating step can be prevented.

According to this embodiment, the anodic oxide film is formed to have the two-layer structure including the first anodic oxide film formed by the AC-DC superimposition and the second anodic oxide film formed by the direct current, and the sealing treatment with the lithium ion sealing liquid is conducted on both of the first and second anodic oxide films. In addition, after the formation of the second anodic oxide film, the first anodic oxide film is formed. Hence, in the two-layer structure, the lower layer is the first anodic oxide film, and the upper layer is the second the anodic oxide film 2. This makes it possible to obtain an anodic oxide film which has both high corrosion resistance based on a synergistic effect of the first anodic oxide film formed by the AC-DC superimposition and the sealing treatment and the high repairing ability based on the second anodic oxide film formed by the direct current and the sealing treatment with the lithium ion sealing liquid.

In addition, the washing step is further conducted between the step of forming the second anodic oxide film and the step of conducting the sealing treatment. This can prevent contamination of the lithium ion sealing liquid with the anodizing treatment liquid attached to the aluminum-based material, which is the workpiece. Consequently, it is possible to always conduct an adequate sealing treatment. In addition, the anodizing treatment liquid in the pores of the second anodic oxide film can be removed. Accordingly, a larger amount of lithium ions can be provided on the inside of the second anodic oxide film. Consequently, it is possible to improve the ability to repair cracks and maintain the repairing effect for a long period.

Moreover, after the anodic oxide film having the two-layer structure is formed and the sealing step is conducted, the repairing step is carried out. The repairing step does not require immersion in a strong acid or an electrolytic treatment. Hence, even after a coating is applied to the aluminum-based material or other parts are attached to the aluminum-based material, a crack can be repaired without exerting any adverse influence on the coating or the other parts. In addition, a crack can be repaired during a production process. For this reason, the repairing step makes it possible to provide an aluminum-based material having excellent corrosion resistance, and can be used for repairing an aluminum-based material and for producing a part using the aluminum-based material. In addition, a larger amount of lithium ions are provided on the surface and the inside of the anodic oxide film obtained with the direct current of the anodic oxide films in the two-layer structure. For this reason, the effect of the repairing ability can be maintained for a longer period than in a case of repairing an anodic oxide film having a single-layer structure of an anodic oxide film obtained by the AC-DC superimposition alone.

An embodiment of an anodic oxide film formed by the above-described treatment method will be described in further detail with reference to the attached drawings.

The anodic oxide film comprises a first anodic oxide film and a second anodic oxide film, and is provided on a surface of an aluminum-based material. The anodic oxide film, the first anodic oxide film, and the second anodic oxide film provide functions such as corrosion resistance and wear resistance to the aluminum-based material. The method for forming the anodic oxide film is the same as described above.

The first anodic oxide film is a porous film provided on the surface of the aluminum-based material by applying AC-DC superimposition electrolysis after the formation of the second anodic oxide film, and has multiple pores (first pores). In addition, the presence of silicon and the like also contributes to the formation of the first pores. Since the first anodic oxide film is dense because of the random orientation (i.e., the first anodic oxide film is not oriented or is slightly oriented), and provides higher corrosion resistance to the aluminum-based material than the second anodic oxide film described later. In other words, the first anodic oxide film can prevent substances that otherwise would cause corrosion from reaching the aluminum-based material.

The first pores of the first anodic oxide film are sealed with either or both of hydrated alumina and a lithium compound. The sealing treatment is the same as described above. The first anodic oxide film having the first pores can provide higher corrosion resistance to the aluminum-based material owing to a synergistic effect of the high denseness and the sealing treatment.

The second anodic oxide film is a porous film provided on a surface of the first anodic oxide film by applying direct current electrolysis. The second anodic oxide film is oriented, and hence has a larger amount of pores (second pores) than the first anodic oxide film. The second anodic oxide film is sparse, and the first anodic oxide film is dense in terms of any or all of the size, number, and distribution of the pores. In addition, the presence of silicon and the like also contributes to the formation of the second pores. The second anodic oxide film also provides corrosion resistance to the aluminum-based material.

The second pores of the second anodic oxide film are sealed with either or both of the hydrated alumina and the lithium compound. The sealing treatment is the same as described above. A larger amount of lithium ions and the lithium compound originated from lithium ions are present in the second anodic oxide film than in the first anodic oxide film. Hence, the second anodic oxide film can provide corrosion resistance to the aluminum-based material and provide a higher ability to repair cracks than the first anodic oxide film, and also makes it possible to maintain the repairing effect for a long period.

The film thickness of the anodic oxide film is preferably, but is not particularly limited to, from 3 μm up to 60 μm from the viewpoint of practicability. Any film thickness necessary for the application can be employed.

Cracks formed in any or all of the anodic oxide film, the first anodic oxide film, the second anodic oxide film, and the aluminum-based material are coated with the lithium compound. Accordingly, the aluminum-based material has high corrosion resistance. The method for repairing a crack is the same as described above.

According to this embodiment, the anodic oxide film has the two-layer structure of the first anodic oxide film obtained by the AC-DC superimposition and the second anodic oxide film obtained with the direct current. In addition, the first anodic oxide film is provided closer to the surface of the aluminum-based material than the second anodic oxide film is. Moreover, lithium ions are present in both of the films. This makes it possible to obtain an anodic oxide film which has both high repairing ability and high corrosion resistance based on the synergic effect of the anodic oxide film obtained by the AC-DC superimposition and the sealing treatment. Moreover, a larger amount of lithium ions is provided on the surface and the inside of the second anodic oxide film of the anodic oxide films in the two-layer structure. For this reason, the effect of the repairing ability can be maintained for a longer period than in a case of repairing an anodic oxide film having a single-layer structure including the first anodic oxide film alone.

Note that, in the above-described embodiment, the anodic oxide film having the two-layer structure including the first anodic oxide film and the second anodic oxide film is shown as an example. However, the present invention is not limited thereto. For example, an anodic oxide film having a three-layer structure can also achieve the same effects as those of the above-described embodiment, as long as a randomly oriented dense first anodic oxide film is formed near a surface of an aluminum-based material and an oriented sparse second anodic oxide film is formed on a surface of the formed first anodic oxide film.

In addition, in the above-described embodiment, the anodizing treatment by direct current electrolysis is shown as an example of the method for forming the second anodic oxide film having a high porosity. However, the present invention is not limited to this method. The second anodic oxide film can also be formed by increasing the porosity by a pore diameter enlargement treatment with a liquid agent. In addition, the pore diameter can be increased also by increasing the voltage, which is an electrolytic treatment condition. For example, a second anodic oxide film having a large pore diameter can be obtained by applying a high voltage in a phosphoric bath.

In addition, the aluminum-based material is shown as an example of the workpiece in the above-described embodiment. However, the present invention is not limited to the aluminum-based material. The workpiece includes aluminum-based members obtained by processing aluminum-based materials into parts and the like. An aluminum-based member includes the aluminum-based material which is a base material and either or both of impurities and additives contained in the aluminum-based material. When an electrolytic treatment is conducted with a positive application to the aluminum-based member (a part to be treated), the aluminum part is dissolved. The dissolved aluminum is bound to oxygen in the treatment liquid to form a fine oxide film on the surface of the aluminum. Such an aluminum-based member can be employed as the workpiece.

Examples of the aluminum-based member include parts for an outboard engine, such as an oil pan, a gear case, and a propeller for an outboard engine. An outboard engine is a propulsion system attached to a marine vessel, and comes into contact with seawater and salt air. Hence, parts constituting an outboard engine are required to have high corrosion resistance. For example, an oil pan, which stores an engine oil and also has a function to cool the engine oil with a stream of air during a cruise, has to come into direct contact with seawater and salt air. For this reason, high corrosion resistance is required. Because of the sufficient corrosion resistance, the aluminum-based member can be used in the application of parts for an outboard engine which must have corrosion resistance.

EXAMPLES

Hereinafter, the present invention will be described specifically based on Examples to clarify effects of the present invention. The anodic oxide film and the method for performing a sealing treatment on the anodic oxide film according to the present invention are not limited to the Examples below.

Test Example 1

An aluminum alloy (AC8A) serving as an aluminum-based material was used as a test piece. The AC8A was anodized by a direct current electrolysis method to form a film of 10 μm to 20 μm. The anodizing treatment was conducted at 1.5 A/dm$^2$ for 20 minutes in a sulfuric acid bath having a concentration of 200 g/L at 20° C. Next, after being washed with water, the test piece was treated with a lithium ion sealing liquid having a lithium ion concentration of 1.7 g/L and a pH of 13 at a temperature at 25° C. for 1 minute, and a washing treatment with water was conducted again. The prepared test piece having a single anodic oxide film made of the direct-current electrolysis anodic oxidation layer was employed as a test piece of Test Example 1.

Test Example 2

An aluminum alloy (AC8A) serving as an aluminum-based material was used as a test piece. The AC8A was anodized by an AC-DC superimposition electrolysis method to form an anodic oxide film of 10 μm to 20 μm. The anodizing treatment was conducted at 10 kHz for 10 minutes in a sulfuric acid bath having a concentration of 200 g/L at 20° C. with the positive electrode of 25 V and the negative electrode of 2 V. Next, after being washed with water, the test piece was treated with a lithium ion sealing liquid having a lithium ion concentration of 1.7 g/L and a pH of 13 at a temperature of 25° C. for 1 minute, and a washing treatment with water was conducted again. The prepared test piece having a single anodic oxide film made of the AC-DC superimposition electrolysis anodic oxidation layer was employed as a test piece of Test Example 2.

Test Example 3

An aluminum alloy (AC8A) serving as an aluminum-based material was used as a test piece. The AC8A was anodized by an AC-DC superimposition electrolysis method to form an anodic oxide film. The anodizing treatment was conducted at 10 kHz for 7 minutes in a sulfuric acid bath having a concentration of 200 g/L at 20° C. with a positive electrode of 25 V and a negative electrode of 2 V. After that, anodization was conducted by a conventional direct current electrolysis method to form a film. The thickness of the film was 10 μm to 20 μm. The anodizing treatment was conducted at 1.5 A/dm$^2$ for 10 minutes in a sulfuric acid bath having a concentration of 200 g/L at 20° C. Next, after being washed with water, the test piece was treated with a lithium ion sealing liquid having a lithium ion concentration of 1.7 g/L and a pH of 13 at a temperature of 25° C. for 1 minute, and a washing treatment with water was conducted again. By the above-described treatments, the test piece was prepared which included the direct-current electrolysis anodic oxidation layer (lower layer) near the immediate vicinity of the aluminum alloy and the AC-DC superimposition electrolysis anodic oxidation layer (upper layer) on the direct-current electrolysis anodic oxidation layer. The prepared test piece having the anodic oxide film of the two-layer structure was employed as a test piece of Test Example 3.

Test Example 4

An aluminum alloy (AC8A) serving as an aluminum-based material was used as a test piece. The AC8A was anodized by a direct current electrolysis method to form an anodic oxide film. The anodizing treatment was conducted at 1.5 A/dm$^2$ for 10 minutes in a sulfuric acid bath having a concentration of 200 g/L at 20° C. After that, anodization was conducted by an AC-DC superimposition electrolysis method to form a film. The anodizing treatment was conducted at 10 kHz for 7 minutes in a sulfuric acid bath having a concentration of 200 g/L at 20° C. with a positive electrode of 25 V and a negative electrode of 2 V. The thickness of the film was 10 μm to 20 μm. Next, after being washed with water, the test piece was treated with a lithium ion sealing liquid having a lithium ion concentration of 1.7 g/L and a pH of 13 at a temperature of 25° C. for 1 minute, and a washing treatment with water was conducted again. By the above-described treatments, the test piece was prepared which included the AC-DC superimposition electrolysis anodic oxidation layer (lower layer) near the immediate vicinity of the aluminum alloy and the direct-current electrolysis anodic oxidation layer (upper layer) on the AC-DC superimposition electrolysis anodic oxidation layer. The prepared test piece having the anodic oxide film of the two-layer structure was employed as a test piece of Test Example 4.

Corrosion Resistance Test

In a corrosion resistance test, a salt spray test was conducted on each of the test samples of Test Examples 1 to 4 for 1000 hours, and the degrees of the corrosion after drying were visually compared with each other. Note that the test samples used for the evaluation of the corrosion resistance were cut out of the test pieces prepared in Test Examples 1 to 4, and the peripheries of the test samples were masked.

By using the test samples 1 to 4, it was found that a good effect of the sealing treatment with lithium ions was provided over the entire region of the anodic oxide film in each test example.

A comparison between Test Example 1 and Test Example 2 showed that the area where the aluminum alloy was exposed or rust was generated was smaller in the test piece of Test Example 2 having the anodic oxide film made of the AC-DC superimposition electrolysis anodic oxidation layer. From this result, it can be seen that an anodization film having a single layer structure has higher corrosion resistance in the case in which the anodic oxide film is formed by an anodizing treatment based on the AC-DC superimposition electrolysis than in the case in which the anodic oxide film is subjected to an anodizing treatment by the direct current electrolysis.

A comparison between Test Example 3 and Test Example 4 showed that the area where the aluminum alloy was exposed or rust was generated was smaller in the test piece of Test Example 4 having the anodic oxide film including the AC-DC superimposition electrolysis anodic oxidation layer as the lower layer and the direct-current electrolysis anodic oxidation layer as the upper layer. From these results, it can be seen that an anodic oxide film having a two-layer structure has higher corrosion resistance in the case in which the anodic oxide film is formed near the interface of the aluminum alloy by the AC-DC superimposition.

Next, a cross-section of the film in the test sample prepared in Test Example 4 was observed after the corrosion resistance test. This observation showed that the direct-current electrolysis anodic oxidation layer was formed as the upper layer in the two-layer structure and the AC-DC superimposition electrolysis anodic oxidation layer was formed as the lower layer in the two-layer structure. The film was not formed easily in the direct-current electrolysis anodic oxidation layer provided as the upper layer because of the presence of silicon, and pores were formed in portions where no film was formed.

Next, the lithium ion concentration (%) in the prepared film was checked after the salt water spraying by using a high-frequency type glow discharge surface analyzer. Part (a) of FIG. 3 shows the lithium ion concentration (%) of Test Example 1 in the film depth direction (s) from the surface, whereas Part (b) of FIG. 3 shows the lithium ion concentration (%) of Test Example 2 in the film depth direction (s) from the surface. Note that, strictly speaking, the film depth direction (s) means the sputtering time (s).

As shown in Parts (a) and (b) of FIG. 3, the lithium ion concentration in the film depth direction from the surface is higher in the direct-current electrolysis anodic oxidation layer of Test Example 1 than in the AC-DC superimposition electrolysis anodic oxidation layer of Test Example 2. From these results, it was shown that a larger amount of lithium ions were present in the anodic oxide film formed by the direct current electrolysis anodization than in the film formed by the AC-DC superimposition electrolysis anodization. In other words, it was found that a larger amount of a lithium compound was present in the anodic oxide film formed by the direct current electrolysis anodization than in the film formed by the AC-DC superimposition electrolysis anodization also after the corrosion resistance test.

From the above-described facts, it was found that a larger amount of pores were present in the film obtained by the anodizing treatment based on the direct current electrolysis than in the film formed by the AC-DC superimposition electrolytic treatment, and a larger amount of the lithium component was present in the anodic oxide film subjected to the sealing treatment using the aqueous alkaline solution containing lithium ions. Thus, the presence of lithium ions on the surface of the anodic oxide film or in the film provides the function to repair cracks formed in the anodic oxide film.

In addition, it was found that the lithium ion concentration was higher in the film formed by the direct current electrolysis anodization than the anodic oxide film formed by the AC-DC superimposition electrolysis anodization also after a corrosion resistance test. The ability to repair cracks is mainly brought about by the lithium compound. The lithium compound facilitates the dissolution of the anodic oxide film, and the dissolution facilitates the hydration reaction with water, so that cracks can be covered in a short period. Note that an aluminum hydrate not containing lithium ions does not undergo this reaction and is unable to cover cracks. The large amount of lithium ions means that a large amount of the lithium compound is formed, and the amount of the aluminum hydrate is small. Since the amount of the hydrate is small, the repair occurs more readily. Accordingly, the film which is formed by the direct current electrolysis anodizing treatment and which has a larger amount of lithium ions can maintain the effect to repair cracks longer.

As described above, the anodic oxide film including the two layers is formed by forming the second anodic oxide film as the upper layer by the direct current electrolysis anodizing treatment, and then forming the first anodic oxide film as the lower layer by the AC-DC superimposition electrolysis anodizing treatment. After that, the sealing treatment using the aqueous alkaline solution containing lithium ions is conducted. It has been found that, in this manner, unprecedented high corrosion resistance and repairing ability can be provided.

INDUSTRIAL APPLICABILITY

The anodic oxide film and the sealing treatment on an anodic oxide film according to the present invention make it possible to improve the corrosion resistance by the anodic oxide film obtained by the AC-DC superimposition and also improve the corrosion resistance by the sealing treatment. In addition, it is possible to simultaneously obtain the high repairing ability by the anodic oxide film obtained by using a direct current and the sealing treatment with the lithium ion sealing liquid.

REFERENCE SIGNS LIST

1: aluminum-based material, 2: anodic oxide film, 2*a*: first anodic oxide film (AC-DC superimposition electrolysis anodic oxidation layer), 2*b*: second anodic oxide film (direct-current electrolysis anodic oxidation layer), 3: hydrated alumina, 4: lithium compound, 5: silicon

The invention claimed is:

1. An anodic oxide film comprising:

a first anodic oxide film on a surface of an aluminum-based material;

a second anodic oxide film on a surface of the first anodic oxide film; and at least one crack, wherein lithium ions are provided inside each crack and on an inside of each of the first and second anodic oxide films, wherein the first and second anodic oxide films are porous films, wherein the first anodic oxide film has a random orientation obtained by applying AC-DC superimposition electrolysis, wherein a silicon is present in each of the first anodic oxide film and the second anodic oxide film, and wherein the first anodic oxide film is between the aluminum-based material and the second anodic oxide film.

2. The anodic oxide film according to claim 1, wherein a number of pores in the second anodic oxide film is larger than a number of pores in the first anodic oxide film.

3. The anodic oxide film according to claim 1, wherein the second anodic oxide film has an ordered orientation and is obtained by applying direct current electrolysis.

4. The anodic oxide film according to claim 1, wherein lithium concentration in the second anodic oxide film is higher than lithium concentration in the first anodic oxide film.

* * * * *